US008366572B1

(12) United States Patent
Joyce

(10) Patent No.: US 8,366,572 B1
(45) Date of Patent: Feb. 5, 2013

(54) THROWING ARROW

(76) Inventor: Peter B. Joyce, Ramona, CA (US)

( * ) Notice: Subject to any disclaimer, the term of this patent is extended or adjusted under 35 U.S.C. 154(b) by 0 days.

(21) Appl. No.: 13/217,644

(22) Filed: Aug. 25, 2011

Related U.S. Application Data

(60) Provisional application No. 61/377,576, filed on Aug. 27, 2010.

(51) Int. Cl.
*A63B 65/02* (2006.01)

(52) U.S. Cl. ..... 473/578

(58) Field of Classification Search ..... 124/20.3; 473/578

See application file for complete search history.

(56) References Cited

U.S. PATENT DOCUMENTS

| | | | |
|---|---|---|---|
| 155,254 | A | 9/1874 | Morgan |
| 305,873 | A | 9/1884 | Williams |
| 876,324 | A | 1/1908 | Brucker |
| 1,468,223 | A | 9/1923 | Baltich |
| 2,435,367 | A | 2/1948 | Ruthven |
| 2,805,517 | A | 9/1957 | Ruthven |
| D254,744 | S | 4/1980 | Pinette |
| 4,429,480 | A | 2/1984 | Stude |
| 4,802,677 | A | 2/1989 | Homan |
| 6,500,042 | B1 | 12/2002 | LaPoints |
| 6,752,682 | B1 | 6/2004 | Ferrell |

*Primary Examiner* — John Ricci
(74) *Attorney, Agent, or Firm* — Virginia P. Shogren

(57) ABSTRACT

A projectile arrow apparatus not requiring a bow comprising a grip member, a notch opening formed within the shaft and a string tether comprising a knot formed in a first end. The tether is retained taut between the knotted end tightly wound within the notch opening and a second end wrapped around a palm of a user's hand while the user's hand grips the grip member. The apparatus is aimed and thrown forward mimicking a typical throwing action to render the apparatus airborne as the knotted end of the tether unwinds and releases from the notch. Forward projectile forces pull on the tether as the user's arm moves in a throwing arc, directing the arrow in a desired trajectory toward a preferred target and sending the arrow significantly further and with significantly more force than if thrown by hand.

19 Claims, 9 Drawing Sheets

THROWING ARROW

CROSS REFERENCE TO RELATED APPLICATION

This application claims priority under 35 USC 119(e) of Provisional Patent Application Ser. No. 61/377,576, filed Aug. 27, 2010, entitled "Throwing Arrow", hereby incorporated by reference in its entirety.

FIELD OF THE INVENTION

The invention relates to the field of bow and arrow projectile weapons, and more particularly to an arrow design that eliminates the need for a bow for shooting while maintaining accuracy of projection and speed and force of propulsion.

BACKGROUND OF THE INVENTION

The bow and arrow together form a projectile weapon. Bows are generally shaped in the form of a flexible arc to shoot aerodynamic projectiles by means of elastic energy. The bow comprises a pair of curved elastic limbs with ends connected by a taut string or cord. As the string or cord is drawn (pulled) backwards (away from the desired direction of the projected arrow), the archer exerts compressive force on the underside of the limbs and tension on the outer sides of the limbs. As a result, while the string is held, energy is stored in the flexible arms of the bow. The energy is transferred to the arrow when the string is released, thereby projecting the arrow further than could be thrown.

Arrows typically consist of a shaft with an arrowhead attached to the front end, with fletch and a nock at the opposed shaft end. The shaft is the primary structural element of the arrow, the stiffness of which is referred to as its "spine." The nock forms a slot opening into which the string on the bow is inserted. The nock keeps the arrow in place on the string as the bow is drawn.

The force required to hold the string stationary at full draw of the bow is used to express the power of the bow, and is known as a "draw weight." A higher draw weight means a more powerful bow that projects arrows at a faster and/or greater distance. For bows drawn by hand, the maximum draw weight is limited by the strength of the archer and the length of the archer's arms.

To project an arrow further than it can be thrown requires a bow. For a successful launch, the bow size must correspond to the size of the archer, and the draw weight must be appropriately matched to the strength of the archer. Consequently, typical archery sets drawn by hand must include different bow sizes and bows of differing draw weights to accommodate the archer's specific needs and attributes. In addition, bow grips are typically designed for right or left handed persons; consequently, special designs with different handgrips are required for left-handed archers as opposed to right-handed archers.

Bows naturally add expense to archery sets. In addition, bows are often difficult to use, particularly by smaller children, due to the difficulty of balancing the arrow on the bow bridge as the arrow is drawn and held prior to release of the arrow. Children who repeatedly drop arrows because they cannot keep the arrow shaft balanced on the bow bridge become frustrated, and their efforts to keep the arrow balanced often interfere with accurate release of the arrow shaft, thereby posing a danger to others involved in the archery activity.

Arrow projectile systems that do not involve a bow are typically considered "toys" due to the fact that the arrow-type projectiles are thrown, but without the ability to aim as in a typical bow and arrow arrangement. For example, sling shots or sticks with elasticized strings can be used to project a rocket-type toy in a general upward trajectory. Swinging slings may also be employed to capitalize on centrifugal forces when spinning the "rocket" prior to its release. However, as with the sling shots, such sling-type launches cannot be readily aimed at targets, and although they provide recreation to the child by allowing a projectile launch in a generally upward trajectory, such toys cannot be used as an effective weapon or for consistent targeting of objects due to the entirely unpredictable trajectory upon release.

Accordingly, there is a long held, un-met need in the art for an arrow projectile system that does not require a bow; which is readily and easily scalable to any size or strength of archer; which may be universally used by right or left handed archers; which projects the arrow in a preferred direction of the archer's aim; which does not require the difficult pulling of a bow string to create potential energy; which results in an arrow being projected further and with more force than if the arrow were simply thrown by hand; which may be used, depending on the arrow design, in multiple settings ranging from recreation to competition to hunting; and which is less costly to the consumer than a typical combined bow and arrow archery set.

THE INVENTION

Summary of the Invention

The inventive Throwing Arrow of this application is a projectile apparatus comprising an elongated shaft member having a generally tapered arrow head on a tip end and a set of fletch secured to the shaft proximate an opposed nock end. A grip member is positioned along the shaft proximate the tip end. A notch opening is formed within the shaft proximate the nock end. A string tether having a defined length comprises a knot formed in a first end. The tether permits taut retention of the tether between the knotted first end tightly wound by a user within the notch opening, on the one hand, and a second end wrapped around a palm of a user's hand while the user's hand grips the grip member, on the other hand.

A method of throwing the apparatus comprises the steps of: 1) placing the knot within the notch opening; 2) pressing down on the knot with a user's first hand; 3) wrapping the tether securely around the knot with a user's second hand to form a wrapped knot; 4) pressing down on the wrapped knot with the user's first hand; 5) grasping the second end of the tether with the user's second hand; 6) wrapping the second end around the user's palm until a thumb and a forefinger of the user's second hand can be firmly applied to the grip member with the tether held in a taut position generally parallel to the shaft between the wrapped knot and the grip member; 7) while maintaining the taut position, releasing the first hand from the wrapped knot and raising the second hand holding the apparatus in an upward direction behind a shoulder of the user to form a typical throwing stance; 8) aiming the tip end toward a desired target; 9) quickly projecting the second hand forward mimicking a typical throwing action of an object; 10) releasing the shaft from the user's second hand to render the apparatus air-borne.

The apparatus, once aimed and thrown forward mimicking a typical throwing action, is rendered air-borne as the knotted end of the tether unwinds and releases from the notch. Forward projectile forces pull on the tether as the user's arm moves in a throwing arc, directing the arrow toward the preferred target and sending the arrow significantly further and with significantly more force than if thrown by hand.

The apparatus does not require any form of bow; is readily and easily scalable to any size or strength of archer; may be universally used by right or left handed archers; projects the arrow in a preferred direction of the archer's aim; does not require the difficult pulling of a bow string to create potential energy; results in an arrow being projected significantly further and with significantly more force than if the arrow were simply thrown by hand; may be used, depending on the arrow design, in multiple settings ranging from recreation to competitions to hunting, and is less costly to the consumer than a typical combined bow and arrow archery set.

BRIEF DESCRIPTION OF THE DRAWINGS

The invention is described in more detail with reference to the attached drawings, in which.

DETAILED DESCRIPTION OF THE ILLUSTRATIVE EMBODIMENT

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the drawings show in schematic, or omit, parts that are not essential in that drawing to a description of a particular feature, aspect or principle of the invention being disclosed. Thus, the best mode embodiment of one feature may be shown in one drawing, and the best mode of another feature will be called out in another drawing.

Throwing Arrow

Figure 1A:
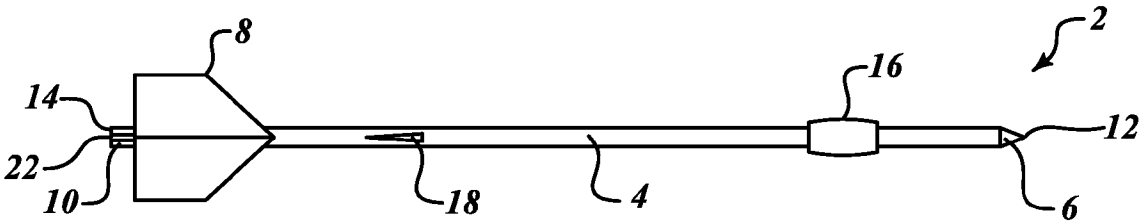
FIG. 1A is a top plan view diagram of the inventive throwing arrow with grip portion and notch.
Figure 1B:
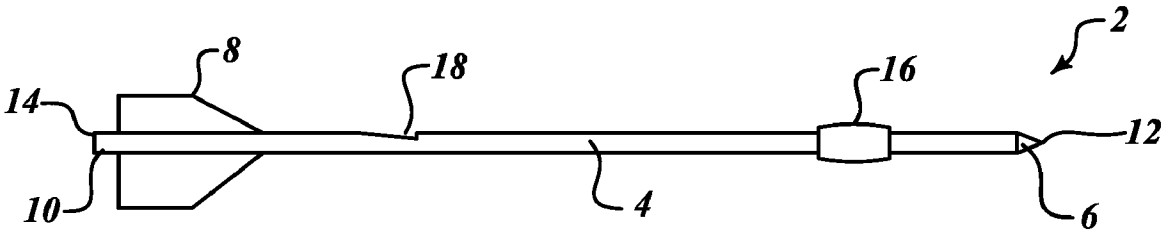
FIG. 1B is a side plan view diagram of the inventive throwing arrow.

FIG. 1A shows a top plan view of the inventive throwing arrow 2 and FIG. 1B is a side plan view diagram of the same embodiment. Referring to FIGS. 1A and 1B, the inventive arrow 2 comprises an elongated shaft member 4 having a generally tapered arrow head 6 on a tip end 12 and a set of fletch 8 secured to the shaft 4 proximate an opposed nock end 14. A grip member 16 is positioned along the shaft 4 proximate the tip end 12. A notch opening 18 is formed within the shaft 4 proximate the nock end 14.

Figure 1C:
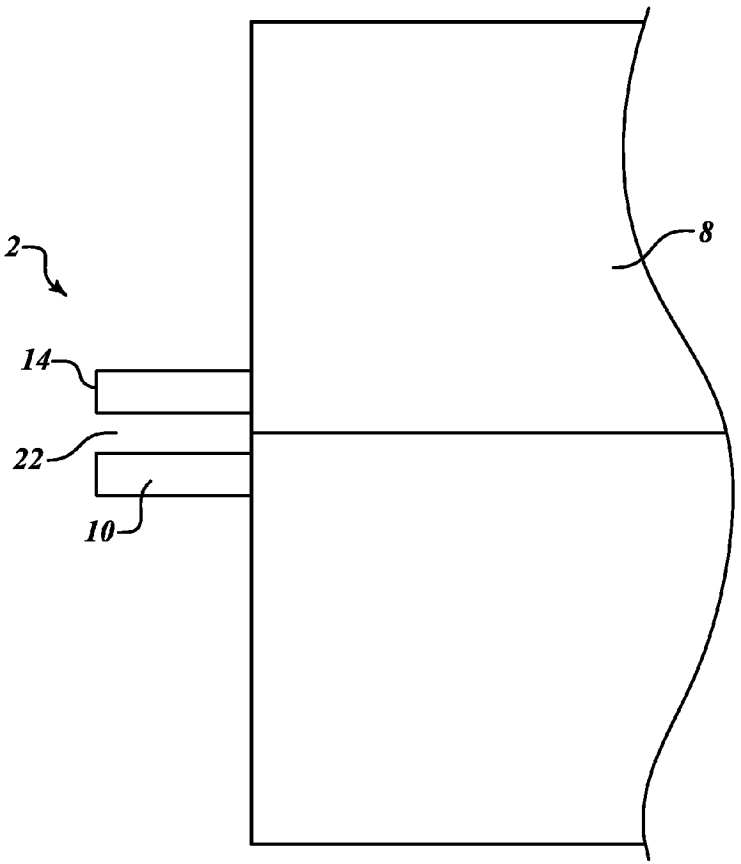
FIG. 1C is an exploded top plan partial view of the nock end of the inventive throwing arrow.
Figure 1D:
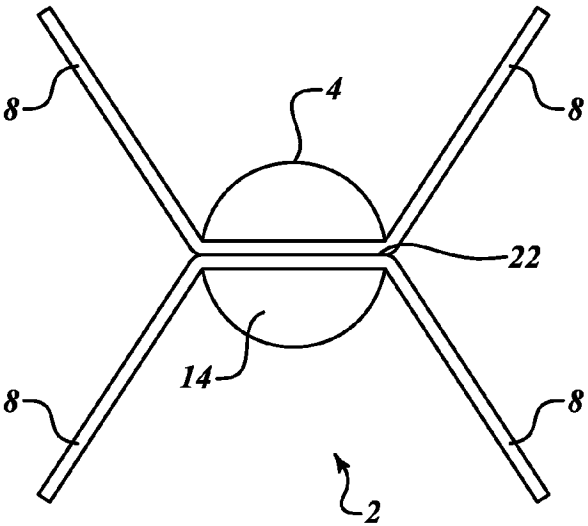
FIG. 1D is an end view diagram of the inventive throwing arrow as viewed from the nock end.

Referring to FIGS. 1A and 1D, the shaft 4 is typically rod shaped with a circular cross-section for minimum air-resistance, but may be of any suitable or desired lateral or cross-sectional shape, and/or may include divot shaped depressions or other similar depressions on the shaft 4 surface to improve flight capabilities. The length of the shaft 4 varies depending on the intended usage and materials utilized to manufacture the arrow 2. For example, when intended for general recreational uses, a shaft 4 length of approximately 20" provides reasonable performance. The shaft 4 may be constructed out of any suitable or desired materials including cane, wood and aluminum.

Referring to FIGS. 1A and 1B, the arrow head 6 may be formed from the arrow shaft 4 as a simple tapered point or may comprise any suitable or desired shape of arrow head formed from the shaft 4 material or attached to the shaft 4 as a separate arrow head, including without limitation, a bodkin point, a blunt point, a judo point, a broadhead, a bullet point, a field tip, a target point, a broadhead, a game point or a safety point.

Referring to FIGS. 1A and 1B, the grip member 16 is shown encircling the shaft 4 proximate to the arrow head 6. The grip member 16 is a band adhered to and around the body of the shaft 4 having an approximate linear length of 1.5 inches. The grip member 16 is sized to permit a forefinger and a thumb of a user's throwing hand (shown in FIGS. 3A and 3B) to pinch and grasp the shaft 4 in the act of throwing the arrow 2. The grip member 16 may be constructed of any suitable or desired material, including plastic, foam, rubber or adhesive tape. The grip member 16 is positioned along the lateral length of the shaft 4 at a location wherein the arrow 2, when held in a user's hand with fingers pinching the grip member 16, is generally balanced (as in a fulcrum) between the force of weight due to the arrow head 6, on the one hand, and the force of weight due to the fletching 8, on the other hand. Due to the typical added weight of an arrow head 6, the grip member 16 is located closer to the tip end 12 than the nock end 14 so as to provide the desired point of balance.

Referring to FIG. 1A, the notch 18 is shown as a triangular, generally V-shaped depression cut away from the body of the shaft 4 proximate the nock end 14 of the arrow 2. Referring to FIG. 1B, the notch 18 in side view forms an approximate 90 degree angle at its base, with a tapered margin extending towards the nock end 14 until flush with the surface of the shaft 4. The notch 18 is approximately 1 inch in lateral length and is sized to permit manual insertion of a knot 24 (shown in FIGS. 2A and 2B).

FIG. 1C shows an exploded partial view of the nock end 14 of the arrow 2, and FIG. 1D shows an end view of the arrow 2 as viewed from the nock end 14. Referring to FIGS. 1C and 1D, the fletching 8 is attached to the shaft 4 via a slot opening 22 cut into the nock end 14 of the shaft 4. The slot opening 22 is shaped for full insertion of the fletch 8 margins with a portion of the nock end 14 exposed as shown in FIG. 1C. The exposed nock end 14 is typically sealed to retain the fletching 8. The nock end 14 is sealed with adhesive tape (not shown) to securely retain the fletching 8 within the slot 22. It should be understood that FIGS. 1A, 1C and 10 show a nock 10 on the arrow 2 due, only, to a nock's typical appearance on arrows as needed to draw back the bow string. As more fully discussed in connection with FIGS. 3A through 3D, a nock 10 is not necessary to the performance of the inventive arrow 2, and the nock 10 may be completely filled or otherwise eliminated.

Referring to FIGS. 1A through 1D, the fletching 8 may be made from any suitable or desired material, including without limitation, plastic, metal, cardboard or feathers. The size and shape of the fletching 8 may also be modified for arrow 2 performance depending on the application used. Fletching 8 may be attached to the shaft 4 by glue and other means typically used for other arrow types.

Figure 2A:
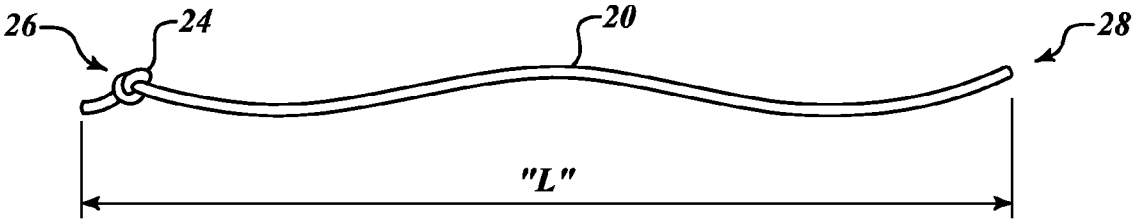
FIG. 2A is a top plan view diagram of a string tether.

FIG. 2A shows an exemplary string tether 20 having a small knot 24 formed at the knot end 26, and a free second end 28. The tether has a defined length "L" which, for an arrow 20 inches in length, is approximately 18 inches longer than the length of the arrow 2, or 38 inches long. In general, the tether length "L" may be approximately two times the length of the shaft 4. As further described in connection with FIGS. 3A through 3D, the length of the tether "L" is designed to permit a sufficient amount of tether 20 proximate its second end 28 to be repeatedly wrapped around a palm of a user's throwing hand. The tether 20 may be constructed from any suitable or desired material, including garden string, nylon, or string materials with elastic and/or stretching properties. The knot 24 may be tied from the tether material 20 itself, may be tied out of a material different from the tether, and/or may comprise a separate member attached to the tether 20, said separate member shaped for insertion and free release from within the notch opening 18.

Figure 2B:
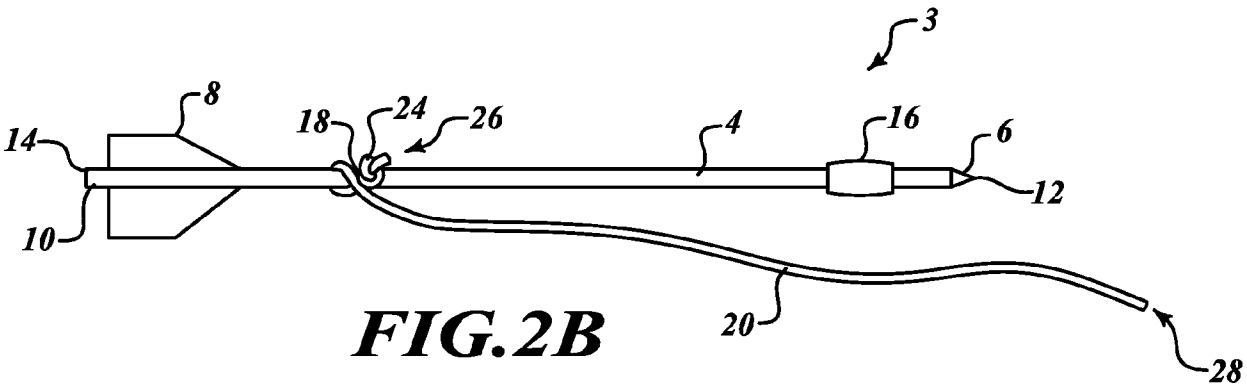
FIG. 2B is a side plan view diagram of the inventive throwing arrow showing a first end of the tether partially wrapped around the notch and a free-hanging second tether end.

Referring to FIG. 2B, a combined arrow and tether apparatus 3 is shown with the knot end 26 of the tether 20 tucked within the notch 18 and wrapped in position with the second tether end 28 hanging below. As described in connection with FIGS. 3A through 3D, the user would typically be manually pressing down on the wrapped knot 24 within the notch 18 with the user's non-throwing hand to keep it from unraveling prior to the throwing action.

Method of Operation

Figure 3A:
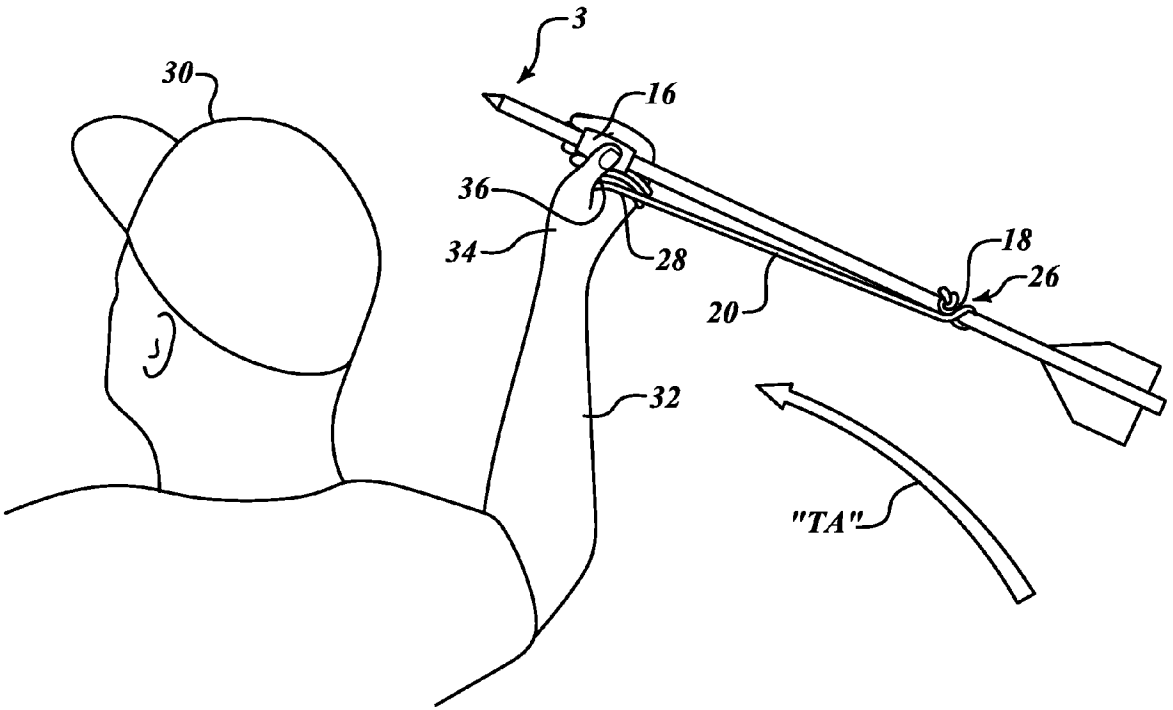
FIG. 3A is a diagram of a user holding the throwing arrow with the user's arm in a raised position behind the shoulder.

FIGS. 3A through 3D show a progression of the throwing arrow 3 being thrown by a user 30. FIG. 3A shows a user 30 holding the throwing arrow 3 with the user's arm 32 in a raised stationary position behind the shoulder immediately prior to moving the arm 32 in the direction of throwing arc "TA". As shown in FIG. 3A, the tether length 20 permits taut retention of the tether 20 between the knotted first end 26 tightly wound by a user 30 within the notch 18, on the one hand, and the second end 28 wrapped around a palm 36 of a user's hand 34 while the user's hand 34 grips the grip member 16, on the other hand. As shown in FIG. 3A, the tether 20 is wrapped around the shaft 4 and over and against the knotted end 26, thereby applying pressure against the knotted end 26 when the device 3 is held taut at the grip 16.

Figure 3B:
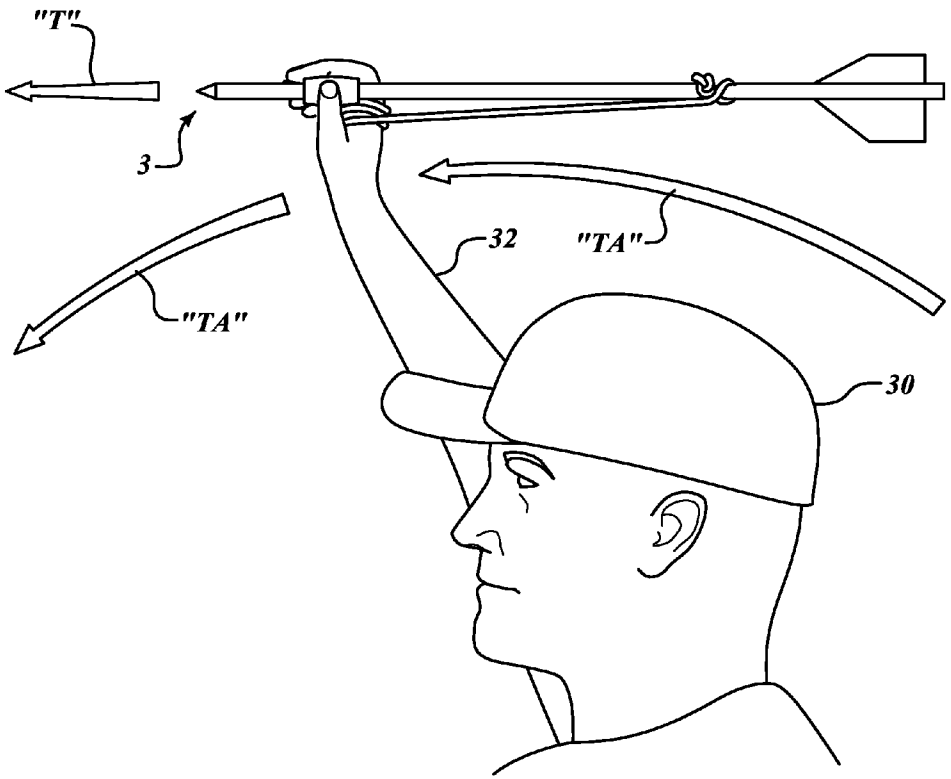
FIG. 3B is a diagram of a user holding the throwing arrow as the user commences a swinging motion of the user's arm.
Figure 3C:
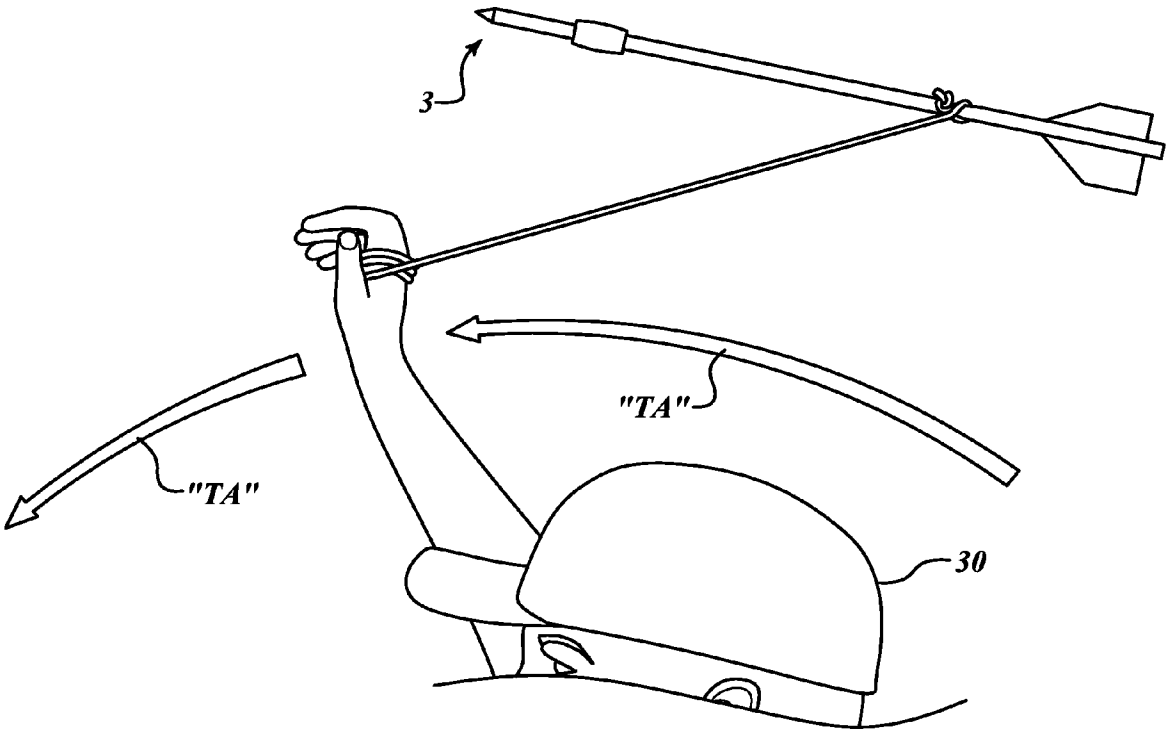
FIG. 3C is a diagram of a user immediately upon release of the throwing arrow; and, FIG. 3D is a diagram of an air-borne throwing arrow immediately following detachment of the tether from the notch.
Figure 3D:
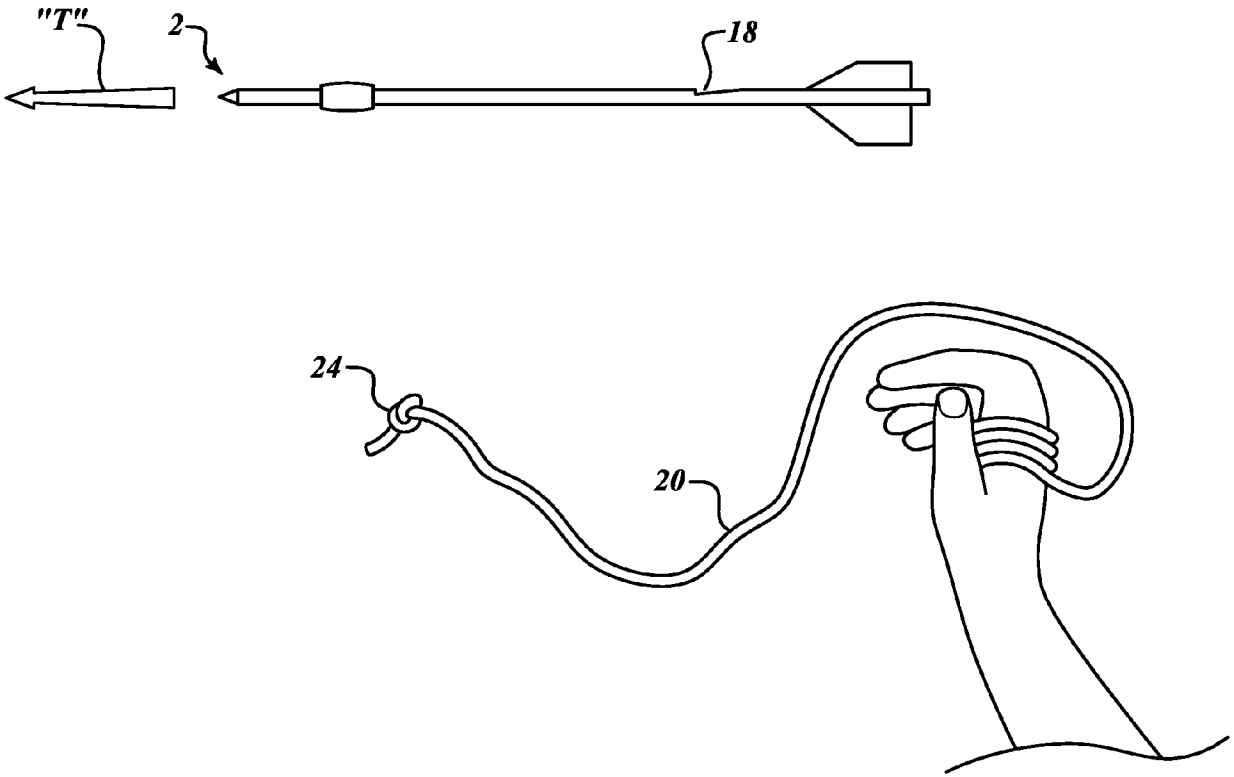

FIG. 3B shows the user 30 holding the throwing arrow 3 as the user 30 commences a swinging motion (throwing arc "TA") of the user's arm 32. FIG. 3C shows the throwing arrow 3 immediately upon release by the user 30. FIG. 3D shows the throwing arrow 2 in free flight, air-borne immediately following the unraveling and detachment of the tether 20 and knot 24 from around and within the notch 18.

Referring to FIGS. 3A through 3D, in operation, a user 30 performs steps comprising: 1) picking up the arrow 2 in one hand, preferably the user's 30 lesser-dominant hand (such as the left hand for a right-handed person); 2) while holding the arrow 2, engaging the knot 24 in the notch 18 and holding the knot 24 in position with the thumb of the lesser-dominant hand; 3) with the opposite hand 34, wrapping a portion of the tether 20 around the shaft 4 at the location of the notch 18 thereby temporarily covering and securing the knot 24 within the notch 18; 4) retaining the wrapped tether 20 in position on the notch 18 with thumb pressure; 5) while continuing to hold the arrow 3 with tether 20 wrapped around the notch 18 with the lesser-dominant hand, wrapping the second end 28 of the tether 20 around the palm 36 of the user's dominant (e.g., right) hand 34, retaining a portion of the tether 20 taut between the notch 18 and the wrapped palm 36; 6) grasping the grip 16 with the dominant hand 34 while releasing the grip of the lesser-dominant hand on the notch 18; 7) raising the dominant hand 34 to position the arrow 3 in a location generally above and behind the user's 30 shoulder; 8) aiming the arrow 3 to the desired throwing direction "T"; 9) thrusting the arm 32 forward in a throwing arc "TA" while releasing the hold on the grip 16, thereby projecting the arrow 3 in the throwing direction "T" away from the user 30 and towards an intended target (not shown).

Referring to FIGS. 3A through 3D, an initial force for projecting the arrow is supplied by the thrusting arm 32 moving forward in the throwing arc "TA" towards the intended target. As the arm 32 moves forward, the pressure of the hand 34 on the grip 16 is released while pressure significantly increases on the wrapped tether 20 around the knot 24 in the notch 18. When the throwing hand 34 releases from the grip 16 entirely, the forward movement of the arrow 3 is maintained and speed of the arrow 3 increases entirely by the tension forces created between the tether 20 wrapped around the notch 18, and the second tether end 28 wrapped around the palm 36 of the throwing hand 34. When the arrow 3 passes the height of the throwing arc "TA", the tether 20 unwinds from around the knot 24 thereby releasing the tether 20 from the arrow shaft 4 and causing the arrow 2 to be in free flight headed in the throwing direction "T" towards the intended target.

Referring to FIG. 3B, the device 3 is capable of being aimed in a desired trajectory "T" as the arm 32 reaches the height of the throwing arc "TA." The trajectory "T" shown in FIG. 3B is generally horizontal to the ground and straight. Referring to FIG. 3D, when the device 2 is air-borne, the trajectory "T" matches the initial aim. As a result, unlike a toy, the device 3 is capable of being used to aim at a particular level target. Alternately, the device 3 may be used for distance competition or recreation by adjusting the throwing arc "TA" upwards, with a resulting trajectory "T" of a wide parabolic path.

Consequently, as shown in FIGS. 3A through 3D, the arrow 2/3, once aimed and thrown forward mimicking a typical throwing action, is rendered air-borne as the knotted end 26 of the tether 20 unwinds and releases from the notch 18. Forward projectile forces pull on the tether 20 as the user's arm 32 moves in the throwing arc "TA" directing the arrow 2 in the desired trajectory "T" toward the preferred target and sending the arrow 2 significantly further and with significantly more force than if thrown by hand alone.

ALTERNATE EMBODIMENTS

It should be understood that various modifications within the scope of this invention can be made by one of ordinary skill in the art without departing from the spirit thereof and without undue experimentation. For example, various forms of the throwing arrow 2/3 may be designed through modifications of materials, dimensions and construction. The notch 18, grip 16 and tether 20 shapes, materials, dimensions and designs may be modified for enhanced performance. Arrow length and width will vary depending on application and system materials used. The location of the grip 16 and notch 18 may change depending on the weight forces of the chosen arrow head 6 and the fletching 8. The grip 16 may fully encircle the shaft 4, or may only partially cover the shaft 4. The grip 16 may be a simple band around the shaft or have a specialized design such as depressions for a thumb and the side of a forefinger for precise holding. The dimensions of the arrow shaft 4 may be significantly increased so as to permit a user to grasp the arrow within the entire palm of a user's hand (without need for grip 16). The fletching 8 may be positioned flush with the nock end 14 due to the lack of any necessity for a nock 10.

With minor modifications, the inventive arrow 2/3 may be utilized in multiple settings, including recreational use as an individual pastime for enjoyment, exercise, to determine how far one can throw an arrow, sharpening one's throwing skills, and so on. The arrow 2/3 may be used in competitions involving targets and/or distance for individual and team events. The arrow 2/3 may be incorporated into hunting activities or military applications for delivering various forms of ordinance. This invention is therefore to be defined as broadly as the prior art will permit, and in view of the specification if need be, including a full range of current and future equivalents thereof.

I claim:

1. A projectile apparatus comprising:

an elongated shaft member having a generally tapered arrow head on a tip end and a set of fletch secured to the shaft proximate an opposed nock end;

a grip member positioned along the shaft proximate the tip end;

a notch opening formed within the shaft proximate the nock end;

a string tether having a defined length, said tether comprising a knot formed in a first end;

said tether length permitting taut retention of the tether between the knotted first end tightly wound by a user within the notch opening, and a second end wrapped around a palm of a user's hand while the user's hand grips the grip member.

2. The apparatus of claim 1, wherein the arrow head is formed from the shaft member as a tapered point.

3. The apparatus of claim 1, wherein the arrow head is chosen from the group consisting of: bodkin point, blunt point, judo point, broadhead, bullet point, field tip, target point, game point, safety point.

4. The apparatus of claim 1, wherein the fletch is spaced apart from the nock end of the shaft.

5. The apparatus of claim 1, wherein the fletch is positioned flush with the nock end of the shaft.

6. The apparatus of claim 1, wherein the grip member is shaped as a band to fully encircle the shaft.

7. The apparatus of claim 1, wherein the grip member comprises depressions formed for a thumb and the side of a forefinger.

8. The apparatus of claim 1, wherein the grip member is positioned along a lateral length of the shaft at a location wherein the apparatus, when held in the user's hand with a user's fingers pinching the grip member, is generally balanced between a first force of weight due to the arrow head, on the one hand, and a second force of weight due to the set of fletch, on the other hand.

9. The apparatus of claim 1, wherein the notch opening is defined by a shallow, generally V-shaped indentation formed in the margin of the shaft.

10. The apparatus of claim 1, wherein the knot is formed from the tether.

11. The apparatus of claim 1, wherein the knot is formed from a material different from the tether.

12. The apparatus of claim 1, wherein the knot comprises a separate member attached to the tether, said separate member shaped for insertion and free release from within the notch opening.

13. The apparatus of claim 1, wherein the defined length of the tether is approximately two times a length of the shaft member.

14. A method of throwing a projectile apparatus comprising an elongated shaft member having a generally tapered arrow head on a tip end and a set of fletch secured to the shaft proximate an opposed nock end; a grip member positioned along the shaft proximate the tip end; a notch opening formed within the shaft proximate the nock end; a string tether having a defined length, said tether comprising a knot formed in a first end; said tether length permitting taut retention of the tether between the knotted first end tightly wound by a user within the notch opening, and a second end wrapped around a palm of a user's hand while the user's hand grips the grip member, the method comprising the steps of:

placing the knot within the notch opening;

pressing down on the knot with a user's first hand;

wrapping the tether securely around the knot with a user's second hand to form a wrapped knot;

pressing down on the wrapped knot with the user's first hand;

grasping the second end of the tether with the user's second hand;

wrapping the second end around the user's palm until a thumb and a forefinger of the user's second hand can be firmly applied to the grip member with the tether held in a taut position and generally parallel to the shaft between the wrapped knot and the grip member;

while maintaining the taut position, releasing the first hand from the wrapped knot and raising the second hand holding the apparatus in an upward direction behind a shoulder of the user to form a typical throwing stance;

aiming the tip end toward a desired target;

quickly projecting the second hand forward mimicking a typical throwing action of an object;

releasing the shaft from the user's second hand to render the apparatus air-borne.

15. The method of claim 14, wherein the arrow head is chosen from the group consisting of: bodkin point, blunt point, judo point, broadhead, bullet point, field tip, target point, game point, safety point.

16. The method of claim 14, wherein the fletch is positioned flush with the nock end of the shaft.

17. The method of claim 14, wherein the grip member comprises depressions formed for a thumb and the side of a forefinger.

18. The method of claim 14, wherein the grip member is positioned along a lateral length of the shaft at a location wherein the apparatus, when held in the user's second hand with a user's fingers pinching the grip member, is generally balanced between a first force of weight due to the arrow head, on the one hand, and a second force of weight due to the set of fletch, on the other hand.

19. The method of claim 14, wherein the knot comprises a separate member attached to the tether, said separate member shaped for insertion and free release from within the notch opening.

* * * * *